US008312849B2

(12) United States Patent
Roe et al.

(10) Patent No.: US 8,312,849 B2
(45) Date of Patent: Nov. 20, 2012

(54) DUAL INTAKE VALVE SYSTEM WITH ONE DEACTIVATION VALVE AND ONE MULTI-LIFT VALVE FOR SWIRL ENHANCEMENT

(75) Inventors: Richard B. Roe, Henrietta, NY (US); Jongmin Lee, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 349 days.

(21) Appl. No.: 12/637,822

(22) Filed: Dec. 15, 2009

(65) Prior Publication Data

US 2011/0139099 A1 Jun. 16, 2011

(51) Int. Cl.
*F01L 1/34* (2006.01)

(52) U.S. Cl. ..... 123/90.16; 123/90.15; 123/90.39; 123/90.44; 123/346

(58) Field of Classification Search ..... 123/90.16, 123/90.39, 90.44, 90.15, 345, 346
See application file for complete search history.

(56) References Cited

U.S. PATENT DOCUMENTS 7,631,631 B2 * 12/2009 Neal et al. ..... 123/198 F

* cited by examiner

*Primary Examiner* — Ching Chang
(74) *Attorney, Agent, or Firm* — Thomas N. Twomey

(57) ABSTRACT

In a dual intake valve arrangement for an internal combustion engine, a variable valve lift system controls two intake valves for one or more engine cylinders. In each cylinder, one of the intake valves includes an associated two-step actuation device, and the other includes an associated valve deactivation device. To improve in-cylinder air flow turbulence, one valve may be operated in a high-lift or low-lift state while the other valve may be deactivated.

19 Claims, 4 Drawing Sheets

DUAL INTAKE VALVE SYSTEM WITH ONE DEACTIVATION VALVE AND ONE MULTI-LIFT VALVE FOR SWIRL ENHANCEMENT

TECHNICAL FIELD OF INVENTION

The invention relates to variable valve lift systems for internal combustion engines; more particularly, to a system for variable valve lift of dual intake valves; and most particularly, to such a system wherein the valvetrain of one of the dual intake valves includes means for multi-lift positioning of that valve and the valvetrain of the other valve includes means for lost motion valve deactivation of that valve.

BACKGROUND OF INVENTION

Variable valve lift systems are known in the engine arts. See, for example, the systems disclosed in U.S. Pat. No. 6,668,779 and US Patent Application Publication No. 2008/0072855 published Mar. 27, 2008, the disclosures of which are both expressly incorporated herein by reference. Such systems typically incorporate a two-step roller finger follower to selectively transmit motion of either a high-lift cam lobe or a low-lift cam lobe of the engine's camshaft to an intake valve.

Valve deactivation systems for selectively activating and deactivating valves are also known. See, for example, U.S. Pat. No. 6,321,704 that discloses a deactivation hydraulic lash adjuster, and U.S. Pat. No. 7,093,572 that discloses a deactivation roller finger follower, the disclosures of which are both expressly incorporated herein by reference. Each of these deactivation systems prevents the rotary motion of a camshaft lobe from being translated into reciprocal motion of the associated valve stem by absorbing the equivalent motion within itself ("lost motion"). Thus the valve is "deactivated" and prevented from opening on schedule.

Customers' expectations of better engine performance and vehicle drivability, ever more stringent governmental regulations regarding engine emissions, and a mutual desire for higher fuel economy are increasingly at odds. Compromises inherent with fixed valve lift and event timing in conventional valvetrains have prompted engine designers to consider variable valve lift systems for more flexible air flow control optimized for each engine load and speed condition, and some variable valve lift systems have now been introduced on production engines. However, addressing critical engineering challenges concerning turbulence (swirl or tumble) enhancement in variable valve lift engines currently requires combustion chamber masking.

Engine combustion strategies in prior variable valve lift systems allow the intake valve to have discrete operational states known as high-lift and low-lift. In the high-lift operational state, the intake valve is allowed to reach a maximum open position, while in the low-lift operational state, the intake valve is only allowed to reach an open position intermediate of the closed and maximum open positions. However, variable valve lift mechanisms on dual intake valve engines have thus far been limited to providing the same lift on both intake valves of each cylinder, which cannot provide any in-cylinder air flow turbulence enhancement.

What is needed in the art is an internal combustion engine variable valve lift system wherein in-cylinder turbulence is enhanced during variable valve lift operation. Therefore, it is a principal object of the present invention to provide increased in-cylinder turbulence during variable valve lift operation of an internal combustion engine.

SUMMARY OF THE INVENTION

Briefly described, the present invention provides a dual intake valve system for an internal combustion engine having a variable valve lift system for both intake valves of one or more engine cylinders. In each such cylinder, the valvetrain of one of the intake valvetrains includes a valve deactivation device and the valvetrain of the other intake valve includes a variable valve lift device such as a two-step roller finger follower.

The intake valvetrain including the valve deactivation device may include a deactivation hydraulic lash adjuster or a deactivation roller finger follower. Optionally, the intake valvetrain including the valve deactivation device can also include a variable valve lift device such as a two-step roller finger follower.

To improve in-cylinder air flow turbulence, each intake valve can be selectively operated at a different lift height, thereby resulting in a higher flow rate of intake air or air/fuel mixture through one intake valve which generates strong swirl by unbalanced flow. In one example of operating dual intake valves of an engine cylinder at different lift heights, one intake valve is operated at high-lift while the other intake valve is operated at low-lift. In another example of operating dual intake valves at different lift heights, one intake valve is operated at high-lift while the other intake valve is deactivated. In yet another example of operating dual intake valves at different lift heights, one intake valve is operated at low-lift while the other intake valve is deactivated.

Thus, the present invention provides a system for variable actuation of first and second intake valves of a cylinder in an internal combustion engine having a camshaft, including a selectively locked two-step actuation device operatively engaging the camshaft and the first intake valve, and a selectively locked valve deactivation device operatively engaging the camshaft and the second intake valve. The two-step actuation device has a high-lift operational state in which the first intake valve reaches a maximum lift open position and a low-lift operational state in which the first intake valve reaches only to an open lift position intermediate a closed position and its maximum lift open position. Selective locking of the two-step actuation device places it in one of its high-lift and low-lift operational states, and selective unlocking of the two-step actuation device places it in the other of its high-lift and low-lift operational states. The valve deactivation device has an activated state of operation in which the second intake valve reaches an open position and a deactivated state of operation in which the second intake valve remains in a closed position. Selective locking of the valve deactivation device places it in one of its activated and deactivated states of operation, and selective unlocking of the deactivation device places it in the other of its activated and deactivated states of operation. The present invention also provides an internal combustion engine having such a system.

The present invention further provides a method of introducing a mixture charge into a combustion chamber of an engine cylinder having a first intake valve and a second intake valve for introducing the mixture charge into the combustion chamber, including: selecting a first valve lift position for the first intake valve that is only one of a high-lift position corresponding to a high-lift operational state and a low-lift position corresponding to a low-lift operational state; opening the first intake valve to the selected first lift position; selecting a second valve state of operation that is only one of an activated state of operation corresponding to the second intake valve reaching an open position and a deactivated state of operation corresponding to the second intake valve remaining closed; and operating at the selected second valve state of operation.

Further features and advantages of the invention will appear more clearly on a reading of the following detailed description of preferred embodiments of the invention, which are given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
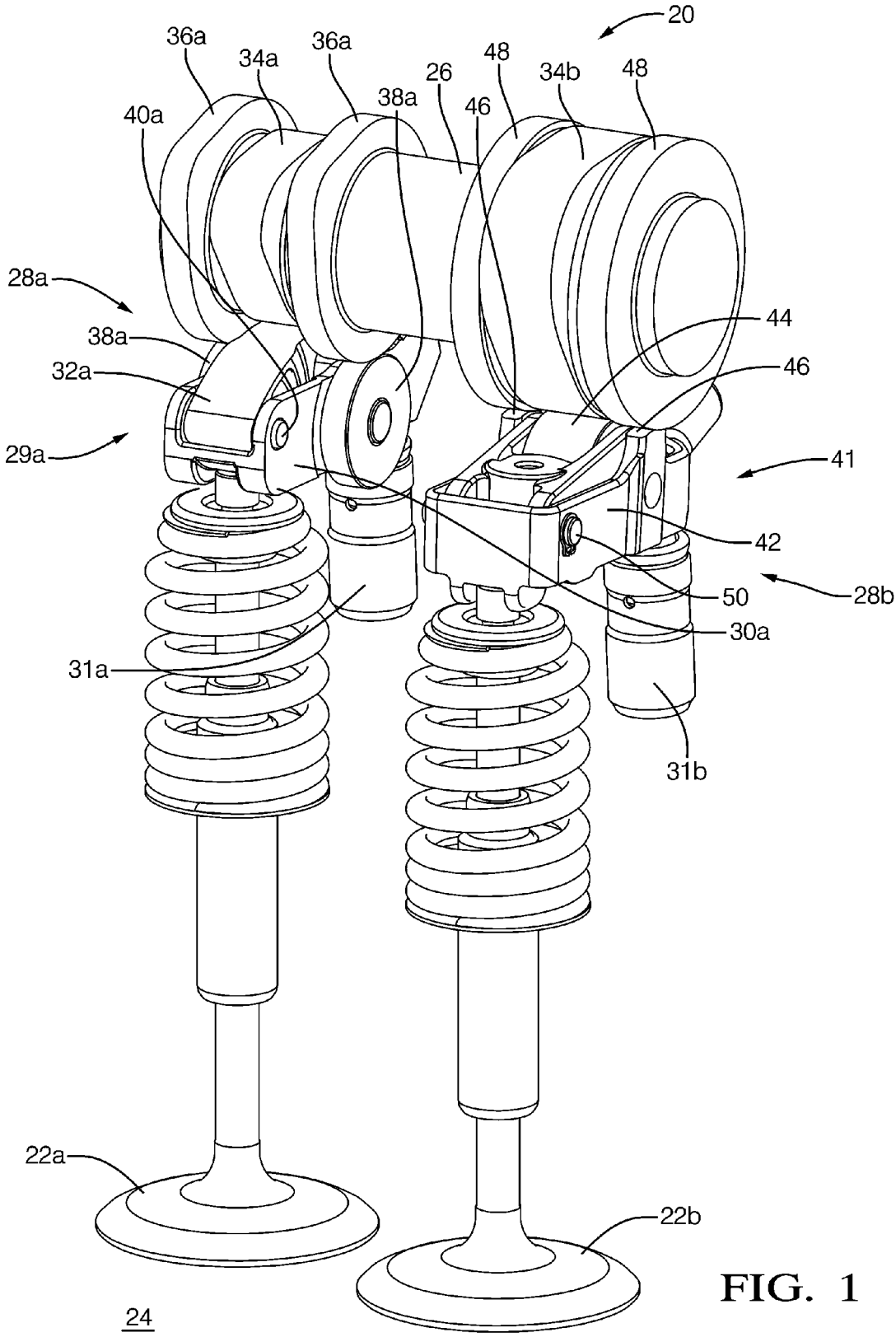
FIG. 1 is an isometric view of a first embodiment of a variable valve lift system and valvetrains in accordance with the present invention.

In accordance with a first preferred embodiment of the invention, FIG. 1 shows variable valve actuation system 20 for providing variable valve lift to first and second intake valves 22*a*, 22*b* which supply an air or air/fuel mixture to internal combustion engine 24. Internal combustion engine 24 may either be compression ignited or spark ignited. Rotational motion of engine camshaft 26 acts on first and second valve actuation means 28*a*, 28*b* for transmitting motion from engine camshaft 26 to first and second intake valves 22*a*, 22*b* respectively.

In the first preferred embodiment, first valve actuation means 28*a* includes first two-step actuation device 29*a* for selectively applying high-lift and low-lift to first intake valve 22*a*. The high-lift operational state is characterized by permitting first intake valve 22*a* to open to a maximum position while low-lift is characterized by permitting first intake valve 22*a* to open only to a position intermediate of the high-lift and valve closed positions. In this embodiment, first two-step actuation device 29*a* takes the form of a two-step rocker arm, and more specifically first two-step roller finger follower 30*a*.

First two-step roller finger follower 30*a* includes first high-lift follower 32*a* to engage and receive input from first high-lift lobe 34*a* of engine camshaft 26. First two-step roller finger follower 30*a* also includes first low-lift rollers 38*a* to selectively engage and receive input from first low-lift lobes 36*a* of engine camshaft 26.

When first two-step roller finger follower 30*a* is selectively in a locked state of operation, or its high-lift operational state, motion from first high-lift lobe 34*a* is transmitted to first intake valve 22*a* through first two-step roller finger follower 30*a* by way of first high-lift follower 32*a*, consequently pivoting first two-step roller finger follower 30*a* about first hydraulic lash adjuster 31*a*, thereby causing first intake valve 22*a* to open to its maximum valve opening position. In this locked state of operation, first low-lift lobes 36*a* do not transmit valve lifting motion to first low-lift rollers 38*a*.

When first two-step roller finger follower 30*a* is selectively in an unlocked state of operation, or its low-lift operational state, motion from first high-lift lobe 34*a* is no longer transmitted to first intake valve 22*a* through first two-step roller finger follower 30*a* by way of first high-lift follower 32*a*. In the unlocked state of operation, first high-lift lobe 34*a* is still permitted to transmit motion to first high-lift follower 32*a*, but the motion is "lost" and not transmitted to first intake valve 22*a* by allowing first high-lift follower 32*a* to pivot about first two-step shaft 40*a*. In its unlocked state of engagement, first high-lift follower 32*a* maintains contact with first high-lift lobe 34*a* by using a spring (not shown) urging first high-lift follower 32*a* into contact with first high-lift lobe 34*a*. When first high-lift follower 32*a* pivots about first two-step shaft 40*a*, motion from first low-lift lobes 36*a* is transmitted to first intake valve 22*a* through first two-step roller finger follower 30*a* by way of first low-lift rollers 38*a*, consequently pivoting first two-step roller finger follower 30*a* about first hydraulic lash adjuster 31*a*, thereby causing first intake valve 22*a* to open to only a low-lift position which is intermediate of the closed and maximum open positions.

First two-step roller finger follower 30*a* is selectively switched between its locked and unlocked states of operation by selectively applying pressurized oil to a latch mechanism (not shown) and selectively relieving the pressurized oil from the latch mechanism. The latch mechanism is locked when pressurized oil is applied thereto, thereby preventing first high-lift follower 32*a* from rotating about first two-step shaft 40*a*. The latch mechanism is unlocked when the pressurized oil is relieved therefrom, thereby causing first high-lift follower 32*a* to pivot about first two-step shaft 40*a*.

In the first preferred embodiment, second valve actuation means 28*b* includes valve deactivation device 41 which takes the form of a deactivation rocker arm, and more specifically, deactivation roller finger follower 42. Valve deactivation device 41 selectively activates and deactivates second intake valve 22*b*. Deactivation roller finger follower 42 includes high-lift roller 44 that engages and receives input from second high-lift lobe 34*b* of engine camshaft 26. Deactivation roller finger follower 42 also includes null pads 46 that follow null lobes 48 of engine camshaft 26. When deactivation roller finger follower 42 is selectively in a locked, or activated state of operation, motion from second high-lift lobe 34*b* is transmitted through deactivation roller finger follower 42 by way of high-lift roller 44, consequently pivoting deactivation roller finger follower 42 about second hydraulic lash adjuster 31*b*, thereby causing second intake valve 22*b* to open to a maximum valve opening position. In this locked state of operation, null lobes 48 are in contact with null pads 46 only when second high-lift lobe 34*b* is not providing lifting motion to second intake valve 22*b*.

Deactivation roller finger follower 42 is selectively switched between its locked and unlocked states of operation by selectively applying pressurized oil to a latch mechanism (not shown) and selectively relieving the pressurized oil from the latch mechanism. The latch mechanism is locked when pressurized oil is applied thereto, thereby preventing high-lift roller 44 from pivoting about deactivation shaft 50. The latch mechanism is unlocked when the pressurized oil is relieved therefrom, thereby allowing high-lift roller 44 to pivot about deactivation shaft 50.

When deactivation roller finger follower 42 is selectively in an unlocked, or deactivated state of operation, second high-lift lobe 34*b* is still permitted to transmit motion to high-lift roller 44, but the motion is "lost" by allowing high-lift roller 44 to pivot about deactivation shaft 50. High-lift roller 44 maintains contact with second high-lift lobe 34*b* by a spring (not shown) urging high-lift roller 44 into contact with second high-lift lobe 34*b*.

When high-lift roller 44 pivots about deactivation shaft 50, null lobes 48 are allowed to maintain contact with null pads 46 for the entire rotation of engine camshaft 26. Null lobes 48 are circular, and sized such that motion is not transmitted to second intake valve 22*b* as engine camshaft 26 rotates, consequently leaving second intake valve 22*b* in a closed position.

Figure 2:
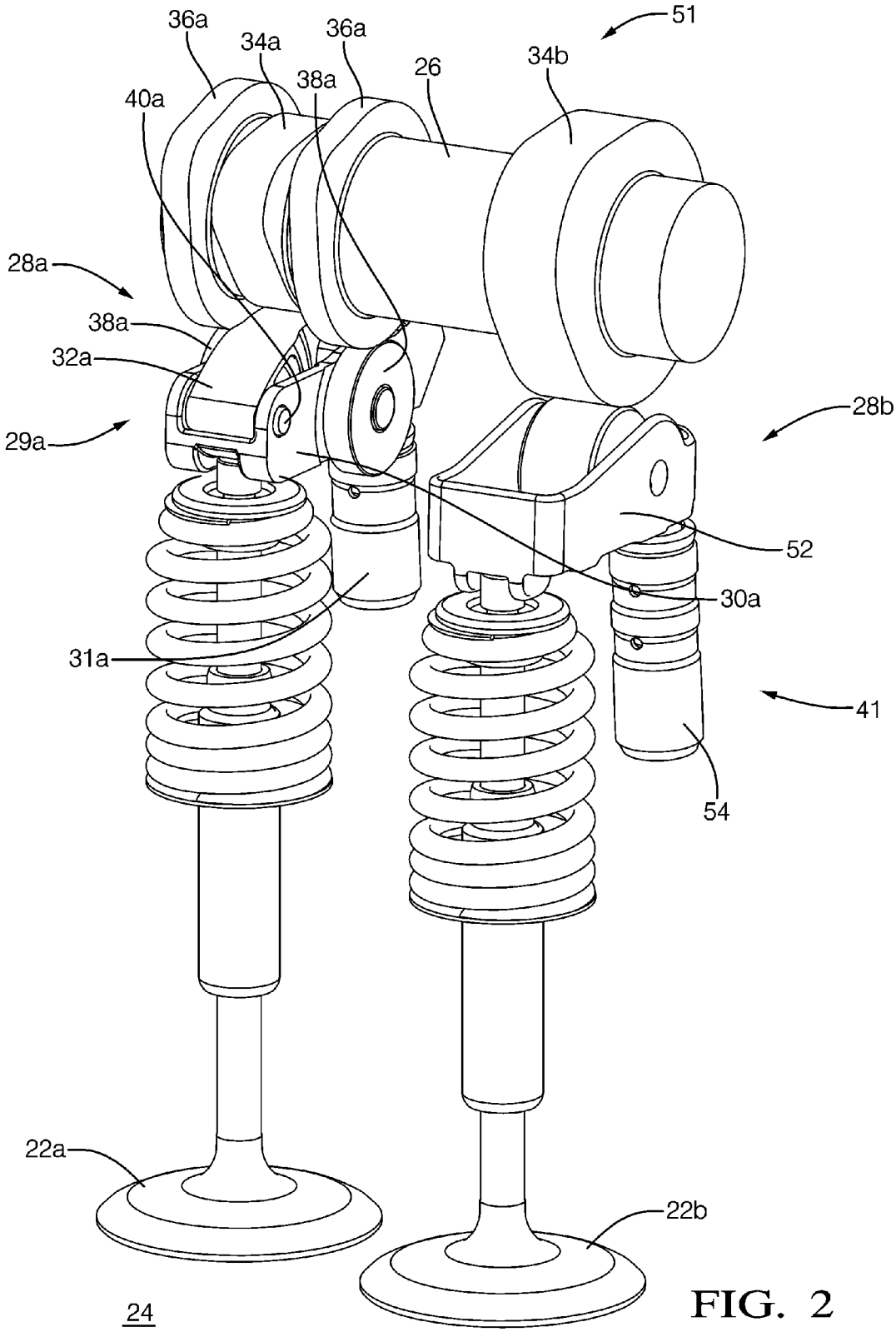
FIG. 2 is an isometric view of a second embodiment of a variable valve lift system and valvetrains in accordance with the present invention.

In accordance with a second preferred embodiment of the invention, FIG. 2, shows second variable valve actuation system 51 for providing variable valve lift to first and second intake valves 22*a*, 22*b* which supply an air or air/fuel mixture to internal combustion engine 24. The second preferred embodiment is the same as the first embodiment with the exception of modifying engine camshaft 26 and valve deactivation device 41. In this embodiment, deactivation roller finger follower 42 (FIG. 1) is replaced with conventional roller finger follower 52 which allows null lobes 48 (FIG. 1) to be removed from engine camshaft 26. Here, deactivation of second intake valve 22*b* is provided by valve deactivation device 41 taking the form of deactivation hydraulic lash adjuster 54 which replaces second hydraulic lash adjuster 31*b* (FIG. 1) of the first embodiment.

When deactivation hydraulic lash adjuster 54 is selectively in a locked, or activated state of operation, motion from second high-lift lobe 34*b* is transmitted through conventional roller finger follower 52, consequently pivoting conventional roller finger follower 52 about deactivation hydraulic lash adjuster 54, thereby causing second intake valve 22*b* to open to a maximum valve opening position. When deactivation hydraulic lash adjuster 54 is selectively in an unlocked, or deactivated state of operation, second high-lift lobe 34*b* acting on conventional roller finger follower 52 causes deactivation hydraulic lash adjuster 54 to compress, thereby allowing second intake valve 22*b* to remain in its closed position under the force of its valve spring regardless of the rotational position of engine camshaft 26.

Deactivation hydraulic lash adjuster 54 is selectively switched between its locked and unlocked states of operation by selectively applying pressurized oil to a latch mechanism (not shown) and selectively relieving the pressurized oil from the latch mechanism. The latch mechanism is unlocked when pressurized oil is applied thereto, thereby allowing deactivation hydraulic lash adjuster 54 to compress. The latch mechanism is locked when the pressurized oil is relieved therefrom, thereby preventing deactivation hydraulic lash 54 from compressing.

Figure 3:
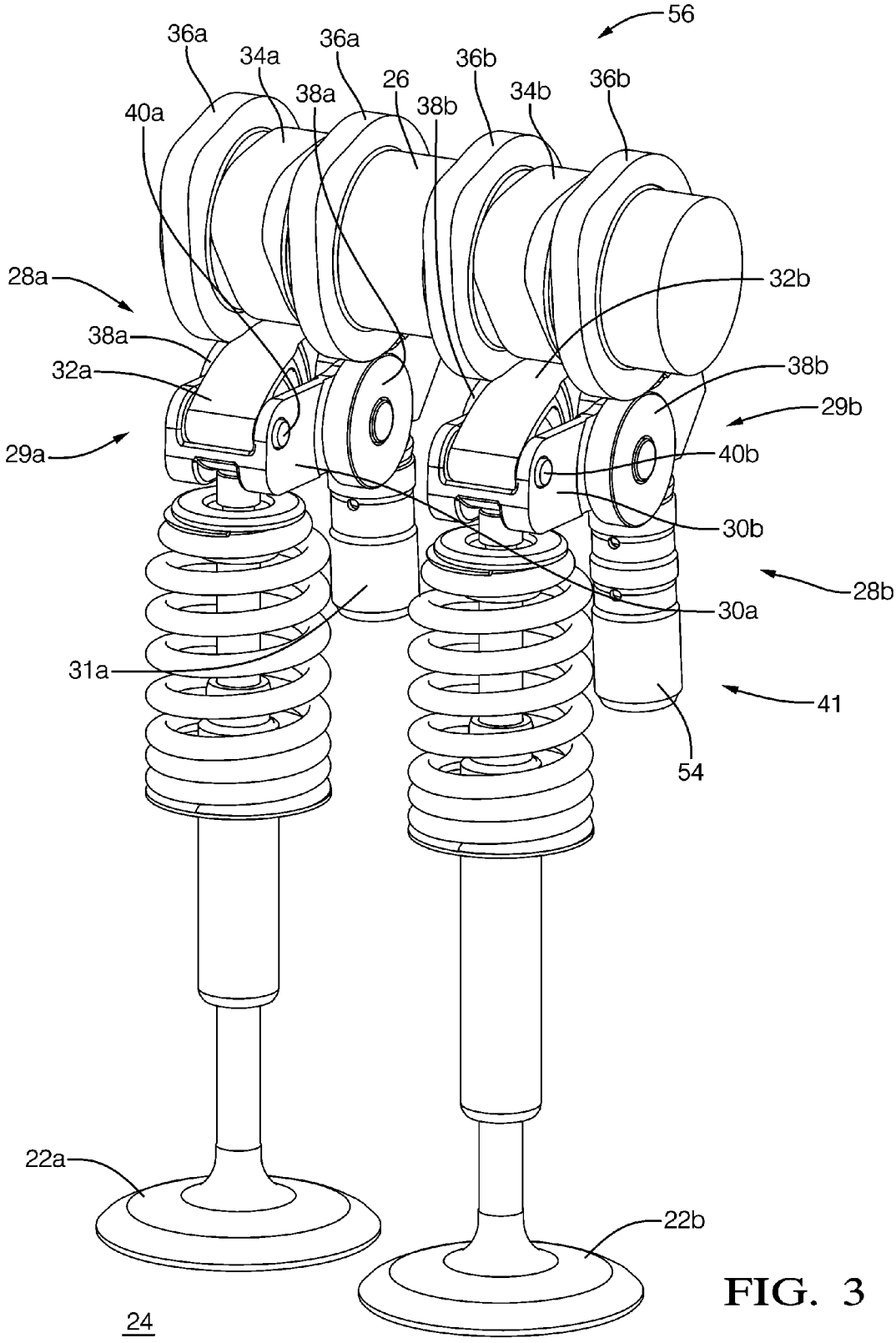
FIG. 3 is an isometric view of a third embodiment of a variable valve lift system and valvetrains in accordance with the present invention.

In accordance with a third preferred embodiment of the invention, FIG. 3 shows third variable valve actuation system 56 for providing variable valve lift to first and second intake valves 22*a*, 22*b* which supply an air or air/fuel mixture to internal combustion engine 24. The third preferred embodiment is the same as the second preferred embodiment with the exception of modifying engine camshaft 26 and substituting second two-step actuation device 29*b* for controlling the lift of second intake valve 22*b*. Second two-step actuation device 29*b* takes the form of a two-step rocker arm, and more specifically, second two-step roller finger follower 30*b*. Second two-step roller finger follower 30*b* includes second high-lift follower 32*b* that engages and receives input from second high-lift lobe 34*b* of engine camshaft 26. Second two-step roller finger follower 30*b* also includes second low-lift rollers 38*b* to selectively engage and receive input from second low-lift lobes 36*b* of engine camshaft 26.

When second two-step roller finger follower 30*b* is selectively in a locked state of operation, or its high-lift operational state, and valve deactivation device 41 is simultaneously in a locked, or activated state of operation, motion from second high-lift lobe 34*b* is transmitted to second intake valve 22*b* through second two-step roller finger follower 30*b* by way of second high-lift follower 32*b*, consequently pivoting second two-step roller finger follower 30*b* about deactivation hydraulic lash adjuster 54, thereby causing second intake valve 22*b* to open to a maximum valve opening position. In the locked state of operation, second low-lift lobes 36*b* do not transmit valve lifting motion to second low-lift rollers 38*b*.

When second two-step roller finger follower 30*b* is selectively in an unlocked state of operation, or its low-lift operational state, and valve deactivation device 41 is simultaneously in a locked, or activated state of operation, motion from second high-lift lobe 34*b* is no longer transmitted to second intake valve 22*b* through second two-step roller finger follower 30*b* by way of second high-lift follower 32*b*. In the unlocked state of operation, second high-lift lobe 34*b* is still permitted to transmit motion to second high-lift follower 32*b*, but the motion is "lost" by allowing second high-lift follower 32*b* to pivot about second two-step shaft 40*b*. Second high-lift follower 32*b* maintains contact with second high-lift lobe 34*b* by a spring (not shown) urging second high-lift follower 32*b* into contact with second high-lift lobe 34*b*. When second high-lift follower 32*b* pivots about second two-step shaft 40*b*, motion from second low-lift lobes 36*b* is transmitted to second intake valve 22*b* through second two-step roller finger follower 30*b* by way of second low-lift rollers 38*b*, consequently pivoting second two-step roller finger follower 30*b* about deactivation hydraulic lash adjuster 54 and causing second intake valve 22*b* to open only to a position intermediate of the closed and maximum opened positions.

Second two-step roller finger follower 30*b* is selectively switched between its locked and unlocked states of operation by selectively applying pressurized oil to a latch mechanism (not shown) and selectively relieving the pressurized oil from the latch mechanism. The latch mechanism is locked when pressurized oil is applied thereto, thereby preventing second high-lift follower 32*b* from rotating about second two-step shaft 40*b*. The latch mechanism is unlocked when the pressurized oil is relieved therefrom, thereby causing second high-lift follower 32*b* to pivot about second two-step shaft 40*b*.

In order to achieve the benefit offered by including first two-step actuation device 29*a* and valve deactivation device 41 as described in each of the three aforementioned embodiments, the ability to selectively choose between high-lift and low-lift operation of first two-step actuation device 29*a* is independent of the ability to selectively choose between activation and deactivation operation of valve deactivation device 41. Additionally, in the third aforementioned embodiment, the ability to selectively choose between high-lift and low-lift operation of second two-step actuation device 29*b* is independent of both the ability to selectively choose between high-lift and low-lift operation of first two-step device 29*a* and the ability to selectively choose between activation and deactivation operation of valve deactivation device 41. The ability to independently select the operation state of each of these devices allows first and second intake valves 22*a*, 22*b* to be operated at different amounts of lift with respect to one another in order to generate in-cylinder air flow turbulence.

Figure 4:
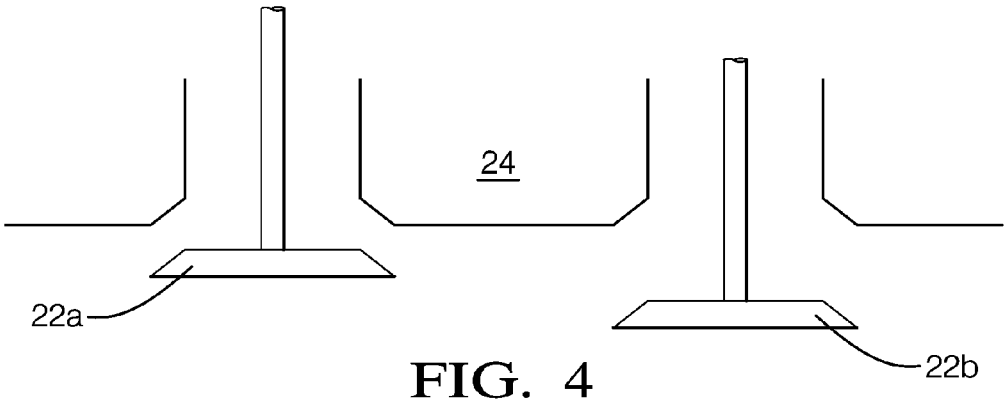
FIG. 4 is a schematic drawing of first and second intake valves in a dual intake valve engine having variable valve lift capability in accordance with the present invention.
Figure 5:
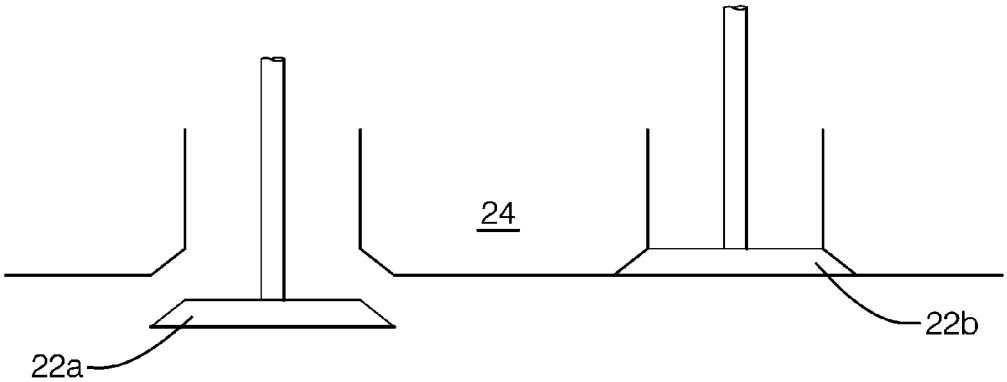
FIG. 5 is a schematic drawing of first and second intake valves in a dual intake valve engine having variable valve lift capability in accordance with the present invention.
Figure 6:
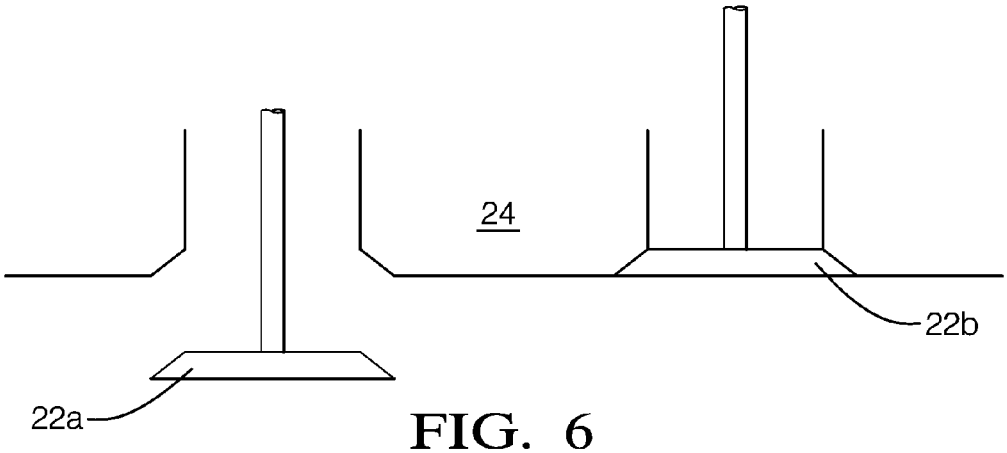
FIG. 6 is a schematic drawing of first and second intake valves in a dual intake valve engine having variable valve lift capability in accordance with the present invention.

The differences in lift height are illustrated in FIGS. 4-6. FIG. 4 illustrates first intake valve 22*a* in a low-lift position which is caused by first two-step actuation device 29*a* (FIGS. 1-3) being in an unlocked state of operation. Simultaneously, second intake valve 22*b* is illustrated in a high-lift position which is caused by valve deactivation device 41 (FIGS. 1-3) being in a locked state of operation. Second two-step actuation device 29*b* (FIG. 3) is also in a locked state of operation when second intake valve 22*b* includes second two-step actuation device 29*b* as described above in the third embodiment.

FIG. 5 also illustrates first intake valve 22*a* in a low-lift position which is caused by first two-step actuation device 29*a* (FIGS. 1-3) being in an unlocked state of operation. However, second intake valve 22*b* is illustrated in a closed position which is caused by valve deactivation device 41 (FIGS. 1-3) being in an unlocked state of operation. Second two-step actuation device 29*b* (FIG. 3) can either be in a locked or unlocked state of operation since the valve deactivation device 41, being in an unlocked state of operation, will override the second two-step actuation device 29*b* when second intake valve 22*b* includes second two-step actuation device 29*b* as described above in the third embodiment.

FIG. 6 illustrates first intake valve 22*a* in a high-lift position which is caused by first two-step actuation device 29*a* (FIGS. 1-3) being in a locked state of operation. Simultaneously, second intake valve 22*b* is illustrated in a closed position which is caused by valve deactivation device 41 (FIGS. 1-3) being in an unlocked state of operation. Second two-step actuation device 29*b* (FIG. 3) can either be in a locked or unlocked state of operation since the valve deactivation device 41, being in an unlocked state of operation, will override the second two-step actuation device 29*b* when second intake valve 22*b* includes second two-step actuation device 29*b* as described above in the third embodiment.

Although not illustrated, one of ordinary skill in the art will now recognize and appreciate that other valve lift combinations can be achieved in accordance with the present invention. For example, first intake valve 22*a* may be in a high-lift operational state while second intake valve 22*b* is simultaneously in a high-lift operational state; first intake valve 22*a* may be in a low-lift operational state while second intake valve 22*b* is simultaneously in a low-lift operational state; and first intake valve 22*a* valve may be in a high-lift operational state while second intake valve 22*b* is simultaneously in the low-lift operational state.

Although not illustrated, one of ordinary skill in the art will now also recognize and appreciate that a valve deactivation device could also be included with the valvetrain for first intake valve 22*a*. Including a valve deactivation device with the valvetrain for first intake valve 22*a* allows for further lift combinations including maintaining both intake valves 22*a*, 22*b* in the closed position for cylinder deactivation.

Although not illustrated, one of ordinary skill in the art will now also recognize and appreciated that further lift combinations can be achieved by providing engine camshaft 26 with first high-lift lobe 34*a* having a different profile than second high-lift lobe 34*b*. Similarly, further lift combinations can be achieved by providing engine camshaft 26 with first low-lift lobes 36*a* having a different profile than second low lift lobes 36*b*.

While the preferred variable valve actuation system embodiments have been described with intake valvetrains commonly known as Type 2 valvetrain, it is to be understood that this invention is similarly applicable to variable valve actuation systems with intake valvetrains of other configurations. Type 2 valvetrains are configured to include a camshaft which provides input to a rocker arm/roller finger follower at a point intermediate of first and second ends of the rocker arm/roller finger follower. The first end of the rocker arm/roller finger follower pivots about a hydraulic lash adjuster while the second end of the rocker arm/roller finger follower provides input to an intake valve.

One alternative valve train configuration that may be used includes a camshaft which provides input to a valve lifter which is placed between the camshaft and an intake valve. This valvetrain configuration is commonly known as Type 1 valvetrain, or direct acting valvetrain.

A second alternative valve train configuration that may be used includes a camshaft that provides input to one end of a rocker arm/roller finger follower while the other end of the rocker arm/roller finger follower provides input to an intake valve. This valvetrain configuration is commonly known as Type 3 valvetrain.

A third alternative valvetrain configuration that may be used includes a camshaft that provides input to a valve lifter which is placed between the camshaft and one end of a rocker arm/roller finger follower while the other end of the rocker arm/roller finger follower provides input to an intake valve. This valvetrain configuration is commonly known as Type 4 valvetrain.

A forth alternative valvetrain configuration that may be used includes a camshaft that provides input to a valve lifter and a push rod which are placed between the camshaft and one end of a rocker arm while the other end of the rocker arm provides input to an intake valve. This valvetrain configuration is commonly known as Type 5 valvetrain, or push rod valvetrain.

While the preferred variable valve actuation system embodiments have been described with two-step actuation devices 29*a*, 29*b*, it is to be understood that this invention is similarly applicable to other multi-step actuation devices such as three or more step actuation devices which are known in the valvetrain art. It is to be understood that a two-step actuation device encompasses these other multi-step actuation devices.

While the preferred variable valve actuation system embodiments have been describe with first and second two-step roller finger followers 30*a* and 30*b*, deactivation roller finger follower 42, and deactivation hydraulic lash adjuster 54 being selectively switched between locked and unlocked states of operation by selectively applying pressurized oil to a latch mechanism (not shown) and selectively relieving the pressurized oil from the latch mechanism, it is to be understood that the latching mechanism could be actuated by means other than pressurized oil. For example, actuation of the latching mechanism could be accomplished electrically. Electrical operation of the latching mechanism could be accomplished, by way of example, with a solenoid actuator, piezoelectric actuator, stepper motor, or any other electric actuation means known to one skilled in the art.

While this invention has been described in terms of preferred embodiments thereof, it is not intended to be so limited, but rather only to the extent set forth in the claims that follow.

We claim:

1. A system for variable actuation of first and second intake valves of a cylinder in an internal combustion engine having a camshaft, comprising:

a selectively locked two-step actuation device operatively engaging the camshaft and said first intake valve, said two-step actuation device having a high-lift operational state in which said first intake valve reaches a maximum lift open position and a low-lift operational state in which said first intake valve reaches only to an open lift position intermediate a closed position and said maximum lift open position, selective locking of said two-step actuation device placing said two-step actuation device in one of said high-lift and low-lift operational states, selective unlocking of said two-step actuation device placing said two-step actuation device in the other of said high-lift and low-lift operational states; and a selectively locked valve deactivation device operatively engaging the camshaft and said second intake valve, said valve deactivation device having an activated state of operation in which said second intake valve reaches an open position and a deactivated state of operation in which said second intake valve remains in a closed position, selective locking of said valve deactivation device placing said valve deactivation device in one of said activated and deactivated states of operation, selective unlocking of said deactivation device placing said valve deactivation device in the other of said activated and deactivated states of operation.

2. The system of claim 1, further comprising a second selectively locked two-step actuation device operatively engaging the camshaft and said second intake valve, said second two-step actuation device having a high-lift operational state in which said second intake valve reaches a maximum lift open position and a low-lift operational state in which said second intake valve reaches only to an open lift position intermediate said closed position and said maximum lift open position, selective locking of said second two-step actuation device placing said second two-step actuation device in one of said high-lift and low-lift operational states, selective unlocking of said second two-step actuation device placing said second two-step actuation device it in the other of said high-lift and low-lift operational states.

3. The system of claim 2, wherein the selective locking and unlocking of said two-step actuation device in connection with said first intake valve is independent of the selective locking and unlocking of said second two-step actuation device in connection with said second intake valve.

4. The system of claim 3, wherein the selective locking and unlocking of said two-step actuation devices respectively in connection with said first and second intake valves is independent of the selective locking and unlocking of said valve deactivation device in connection with said second intake valve.

5. The system of claim 1, wherein said two-step actuation device comprises a high-lift follower and a low-lift roller, said high-lift follower in continuous contact with a high-lift lobe of the camshaft, said low-lift roller in continuous contact with a low-lift lobe of the camshaft only in said low-lift operational state.

6. The system of claim 1, wherein said valve deactivation device comprises a high-lift roller and a null pad, said high-lift roller in continuous contact with a high-lift lobe of the camshaft, said null pad in continuous contact with a null lobe of the camshaft only in said deactivated state of operation.

7. The system of claim 1, wherein said second intake valve is in operative engagement with the camshaft through a high-lift roller in continuous contact with a high-lift lobe of the camshaft, and said valve deactivation device comprises a deactivation hydraulic lash adjuster, and when in its said deactivated state of operation said deactivation hydraulic lash adjuster is compressed.

8. The system of claim 7, further comprising a second selectively locked two-step actuation device operatively engaging the camshaft and said second intake valve, said second two-step actuation device having a high-lift operational state in which, when said valve deactivation device is in said activated state of operation, said second intake valve reaches a maximum lift open position and a low-lift operational state in which said second intake valve reaches only to an open lift position intermediate said closed position and said maximum lift open position, selective locking of said valve deactivation device and of said second two-step actuation device placing said second two-step actuation device in one of said high-lift and low-lift operational states, selective locking of said valve deactivation device and unlocking of said second two-step actuation device placing said second two-step actuation device in the other of said high-lift and low-lift operational states.

9. The system of claim 1, wherein said valve deactivation device is a deactivation rocker arm.

10. The system of claim 9, wherein said deactivation rocker arm is a deactivation roller finger follower.

11. The system of claim 1, wherein said valve deactivation device is a deactivation hydraulic lash adjuster.

12. The system of claim 1, wherein said two-step actuation device is a two-step rocker arm.

13. The system of claim 12, wherein said two-step rocker arm is a two-step roller finger follower.

14. The system of claim 1, wherein the selective locking and unlocking of said two-step actuation device in connection with said first intake valve is independent of the selective locking and unlocking of said valve deactivation device in connection with said second intake valve.

15. An internal combustion engine having a camshaft and having first and second intake valves per cylinder, comprising a system for variable actuation of said first and second intake valves including:

a selectively locked two-step actuation device operatively engaging the camshaft and said first intake valve, said two-step actuation device having a high-lift operational state in which said first intake valve reaches a maximum lift open position and a low-lift operational state in which said first intake valve reaches only to an open lift position intermediate a closed position and said maximum lift open position, selective locking of said two-step actuation device placing said two-step actuation device in one of said high-lift and low-lift operational states, selective unlocking of said two-step actuation device placing said two-step actuation device in the other of said high-lift and low-lift operational states; and a selectively locked valve deactivation device operatively engaging the camshaft and said second intake valve, said valve deactivation device having an activated state of operation in which said second intake valve reaches an open position and a deactivated state of operation in which said second intake valve remains in a closed position, selective locking of said valve deactivation device placing said valve deactivation device in one of said activated and deactivated states of operation, selective unlocking of said deactivation device placing said valve deactivation device in the other of said activated and deactivated states of operation.

16. The internal combustion engine of claim 15, further comprising a second selectively locked two-step actuation device operatively engaging the camshaft and said second intake valve, said second two-step actuation device having a high-lift operational state in which said second intake valve reaches a maximum lift open position and a low-lift operational state in which said second intake valve reaches only to an open lift position intermediate its said closed position and its said maximum lift open position, selective locking of said second two-step actuation device placing it in one of its said high-lift and low-lift operational states, selective unlocking of said second two-step actuation device placing it in the other of its said high-lift and low-lift operational states.

17. The internal combustion engine of claim 15, wherein said engine is selected from the group consisting of compression ignited and spark ignited.

18. A method of introducing a mixture charge into a combustion chamber of an engine cylinder, the cylinder including a first intake valve and a second intake valve for introducing the mixture charge into the combustion chamber, comprising:

selecting a first valve lift position for the first intake valve that is only one of a high-lift position corresponding to a high-lift operational state and a low-lift position corresponding to a low-lift operational state;

opening the first intake valve to the selected first lift position;

selecting a second valve state of operation that is only one of an activated state of operation corresponding to the second intake valve reaching an open position and a deactivated state of operation corresponding to the second intake valve remaining closed; and operating at the selecting second valve state of operation.

19. The method of claim 18 in which the second valve activated state of operation is selected, and further comprising:

selecting a second valve lift position for the second intake valve that is only one of a high-lift position corresponding to a high-lift operational state and a low-lift position corresponding to a low-lift operational state; and opening the second intake valve to the selected second lift position.

* * * * *